US007734463B1

(12) United States Patent
McKay

(10) Patent No.: US 7,734,463 B1
(45) Date of Patent: Jun. 8, 2010

(54) SYSTEM AND METHOD FOR AUTOMATED VOICE INFLECTION FOR NUMBERS

(75) Inventor: Forrest McKay, Allen, TX (US)

(73) Assignee: Intervoice Limited Partnership, Reno, NV (US)

( * ) Notice: Subject to any disclaimer, the term of this patent is extended or adjusted under 35 U.S.C. 154(b) by 1564 days.

(21) Appl. No.: 10/964,046

(22) Filed: Oct. 13, 2004

(51) Int. Cl.
*G10L 11/04* (2006.01)

(52) U.S. Cl. ..... 704/207; 704/208; 704/260

(58) Field of Classification Search ..... None
See application file for complete search history.

(56) References Cited

U.S. PATENT DOCUMENTS

| | | | | |
|---|---|---|---|---|
| 6,161,092 | A | 12/2000 | Latshaw et al. | |
| 6,873,952 | B1 * | 3/2005 | Bailey et al. | 704/251 |
| 2002/0103648 | A1 * | 8/2002 | Case et al. | 704/260 |
| 2002/0193995 | A1 * | 12/2002 | Case et al. | 704/260 |
| 2003/0207701 | A1 * | 11/2003 | Rolnik et al. | 455/564 |
| 2005/0240410 | A1 * | 10/2005 | Charles et al. | 704/270 |
| 2007/0055632 | A1 * | 3/2007 | Hogl | 705/65 |

* cited by examiner

*Primary Examiner*—Richemond Dorvil
*Assistant Examiner*—Leonard Saint Cyr
(74) *Attorney, Agent, or Firm*—William S. Morriss; Frost Brown Todd LLC

(57) ABSTRACT

The present invention is directed to systems and methods in which a speaker records strings of numbers in different string lengths. Advantage is taken of the fact that speakers typically break numbers into group sizes of two, three, or four. Thus, by way of example, a recorder records two 0's, two 2s, two 3s, etc. Then the recorder records three 1s, three 2s, three 3s, etc., followed by four 1s, four 2s, four 3s, etc. The spoken number values for each string are broken apart and stored as individual numbers corresponding to the string length of the recording. When a number string is to be spoken (for example, the number 782), the system retrieves from the three digit string a first 7, a middle 8, and an end 2. When these retrieved values are communicated to a recipient, proper inflections are achieved for each digit.

26 Claims, 1 Drawing Sheet

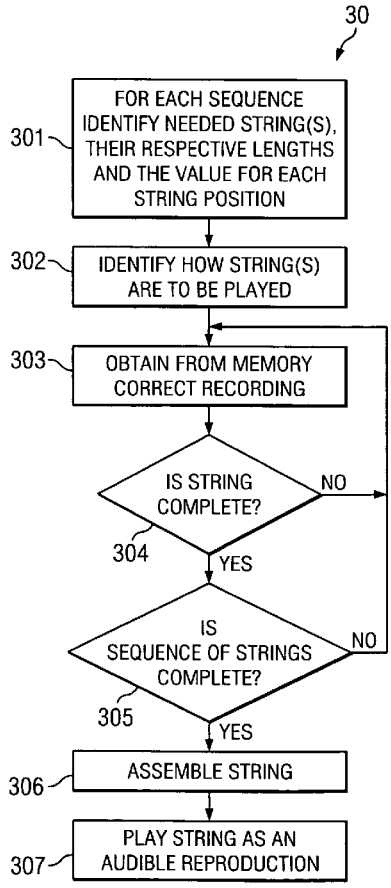

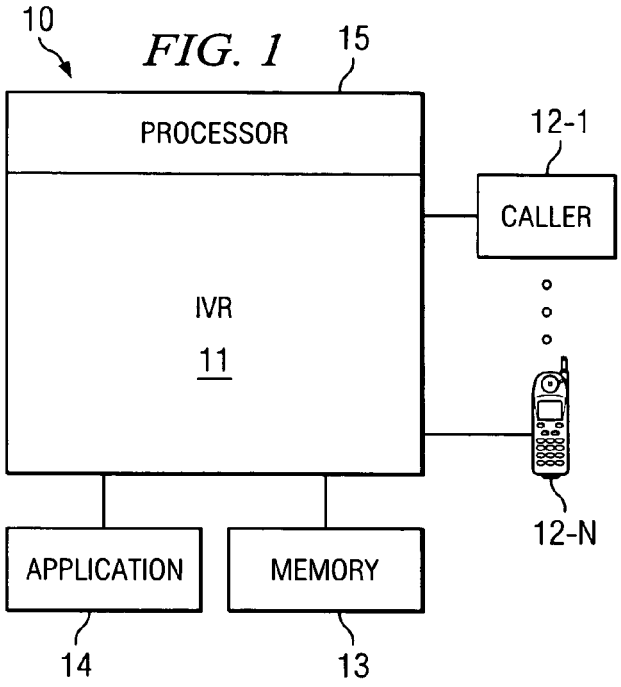
10
FIG. 1
15
PROCESSOR
IVR
11
12-1
CALLER
12-N
APPLICATION
MEMORY
14
13

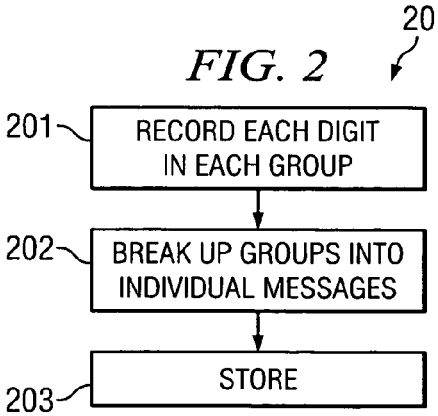
20
FIG. 2
201
RECORD EACH DIGIT IN EACH GROUP
202
BREAK UP GROUPS INTO INDIVIDUAL MESSAGES
203
STORE

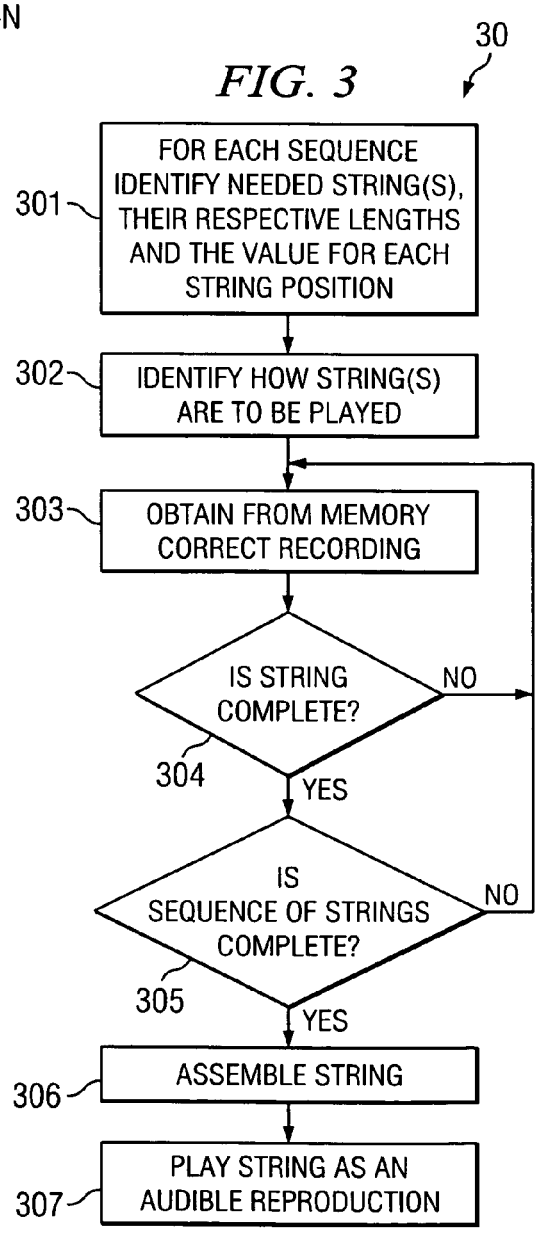
30
FIG. 3
301
FOR EACH SEQUENCE IDENTIFY NEEDED STRING(S), THEIR RESPECTIVE LENGTHS AND THE VALUE FOR EACH STRING POSITION
302
IDENTIFY HOW STRING(S) ARE TO BE PLAYED
303
OBTAIN FROM MEMORY CORRECT RECORDING
IS STRING COMPLETE?
NO
304
YES
IS SEQUENCE OF STRINGS COMPLETE?
NO
305
YES
306
ASSEMBLE STRING
307
PLAY STRING AS AN AUDIBLE REPRODUCTION

SYSTEM AND METHOD FOR AUTOMATED VOICE INFLECTION FOR NUMBERS

TECHNICAL FIELD

This disclosure related to automated speech systems and more particularly to a system and method for imparting the proper inflection to numbers.

BACKGROUND OF THE INVENTION

In many automated systems it is necessary to provide spoken numbers under automated control. For example, in an interaction voice response (IVR) system it is necessary to an automated system to "speak" numbers from time to time. Such a number could be, for example, "your balance is 5 dollars and 38 cents." Usually the response is a number sequence having individual strings. An example would be "your account number is 38 4041 256," having three strings in the sequence. The first string having a length of 2, the second string length being 4, and the fourth string length of 3.

Current IVR systems have ten numbers (0-9) prerecorded. In order to create a group of numbers, the prerecorded numbers are concatenated together in the right order. This was acceptable in situations where the user (listener) was inputting numbers using mechanical touch-tones. In such systems, it was expected that any voice response would sound mechanical. However, as systems began to migrate toward speech recognition, user's have begun to want the "speech" coming from an automated system to be more conversational, such that the message coming to them sounds to them the way a real person would speak.

When a real person says a number string, such as a phone number, the string, such as 972-454-8316 has pauses inserted and each number has an inflection based on where in the string the number falls. Concatenated number strings played to a user do not have the proper inflections and thus such systems are becoming unacceptable.

BRIEF SUMMARY OF THE INVENTION

The present invention is directed to a system and method which begins with a speaker recording strings of numbers in different string lengths. The system takes advantage of the natural speech patterns that occur when numbers are reached in strings. For instance, social security numbers, phone numbers, zip codes are spoken in groups and people naturally say them a certain way. Advantage is taken of the fact that speakers typically break numbers into group sizes of two, three, or four. Thus, by way of example, a recorder (speaker) records two 0's, two 2s, two 3s, etc. Then the recorder records three 1s, three 2s, three 3s, etc., followed by four 1s, four 2s, four 3s, etc. Then these strings are were broken apart and stored. Advantage is taken of the upward inflection, the middle inflection, and the downward inflections that are imparted to each number dependent upon its position in the string as well as the length of the string. When a number string is to be spoken (for example, the number string 782), the system retrieves from the stored three digit number strings a first 7, a middle 8, and an end 2. Using systems and methods discussed herein the proper inflections are achieved for each digit when these referenced number values are transmitted to a recipient.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 1 shows one embodiment of a system utilizing the concepts discussed herein;

FIG. 2 shows one embodiment of a process for recording digits; and

FIG. 3 shows one embodiment of a process for speaking a string of numbers.

DETAILED DESCRIPTION OF THE INVENTION

Turning now to FIG. 1 there is shown system 10 which includes IVR 11, and processor 15 which controls the system and accepts call from callers 12-1 to 12-N. At times, the IVR system will be required to provide voice messages to one or more callers. These voice messages will also, from time to time, require strings of numbers to be communicated. As will be discussed, these numbers are communicated, for example, under control of application 14 working in conjunction with memory 13.

Note that while the stored sound values are shown in conjunction with IVR 10 (FIG. 1) they could be stored remotely, for example in a remote device, for example in mobile device 12-N. In such a situation, system 10 could send codes identifying a string of numbers and the string could be assembled and played under control of a processor (not shown) in device 12-N. Also note that the mobile device (or a remote wireline device) can be used to verbally send number strings to another device, mobile or otherwise. If the remote device is used to send number strings to an automated system (perhaps instead of sending touch-tones) then the string length L could be as long as desired.

FIG. 2 shows one embodiment 20 wherein process 201 records each digit in each string for a first string of number values where the string has length (L). Thus, for L=1 the recorded values are stored as shown in Table A1 under the message names 001.wav-010.wav. (Note that Table A1 is shown for completeness only and since it is a special string it is treated as if it has always been treated, ie., simply stored as recorded.)

TABLE A1

| Digit Recorded | Message Name |
|---|---|
| 1 | 001.wav |
| 2 | 002.wav |

TABLE A1-continued

| Digit Recorded | Message Name |
|---|---|
| 3 | 003.wav |
| 4 | 004.wav |
| 5 | 005.wav |
| 6 | 006.wav |
| 7 | 007.wav |
| 8 | 008.wav |
| 9 | 009.wav |
| 0 | 010.wav |

For a string where L=2 the spoken values are stored in files with names temp2 of 1.wav-temp2 of o.wav, as shown in Table A2.

TABLE A2

| Digit Recorded | Message Name |
|---|---|
| 11 | temp2of1.wav |
| 22 | temp2of2.wav |
| 33 | temp2of3.wav |
| 44 | temp2of4.wav |
| 55 | temp2of5.wav |
| 66 | temp2of6.wav |
| 77 | temp2of7.wav |
| 88 | temp2of8.wav |
| 99 | temp2of9.wav |
| 00 | temp2of0.wav |

For a string where L=3 the spoken values are stored in files with names temp3 of 1.wav-temp3 of 0.wav as shown in Table A3.

TABLE A3

| Digit Recorded | Message Name |
|---|---|
| 111 | temp3of1.wav |
| 222 | temp3of2.wav |
| 333 | temp3of3.wav |
| 444 | temp3of4.wav |
| 555 | temp3of5.wav |
| 666 | temp3of6.wav |
| 777 | temp3of7.wav |
| 888 | temp3of8.wav |
| 999 | temp3of9.wav |
| 000 | temp3of0.wav |

For a string where L=4 the spoken values are stored in files with names temp4 of 0.wav as shown in Table A4.

TABLE A4

| Digit Recorded | Message Name |
|---|---|
| 1111 | temp4of1.wav |
| 2222 | temp4of2.wav |
| 3333 | temp4of3.wav |
| 4444 | temp4of4.wav |
| 5555 | temp4of5.wav |
| 6666 | temp4of6.wav |
| 7777 | temp4of7.wav |
| 8888 | temp4of8.wav |
| 9999 | temp4of9.wav |
| 0000 | temp4of0.wav |

For a string where L=5, the spoken values are stored in files with names temp5 of 0.wav as shown in Table A5.

TABLE A5

| Digit Recorded | Message Name |
|---|---|
| 11111 | temp5of1.wav |
| 22222 | temp5of2.wav |
| 33333 | temp5of3.wav |
| 44444 | temp5of4.wav |
| 55555 | temp5of5.wav |
| 66666 | temp5of6.wav |
| 77777 | temp5of7.wav |
| 88888 | temp5of8.wav |
| 99999 | temp5of9.wav |
| 00000 | temp5of0.wav |

Note that the number values for each position within each string are the same (1,1,1; 2,2,2; etc.). This is done for convenience in recording and in further processing. The numbers could be recorded randomly so long as for each string length L there is a first, second, third, etc. value recorded for each digit 0-9.

Process 202 of FIG. 2 breaks up the stored strings into individual one-digit message values giving them each a unique name. These broken up individual values are stored under control of process 203, as shown in Table B for the three-digit string of numbers. There will be twenty messages for the two-digit string and forty messages for the four-digit string.

TABLE B

| Three-Digit String |
|---|
| FirstOneOfThree.wav |
| SecondOneOfThree.wav |
| ThirdOneOfThree.wav |
| FirstTwoOfThree.wav |
| SecondTwoOfThree.wav |
| ThirdTwoOfThree.wav |
| FirstThreeOfThree.wav |
| SecondThreeOfThree.wav |
| ThirdThreeOfThree.wav |
| FirstFourOfThree.wav |
| SecondFourOfThree.wav |
| ThirdFourOfThree.wav |
| FirstFiveOfThree.wav |
| SecondFiveOfThree.wav |
| ThirdFiveOfThree.wav |
| FirstSixOfThree.wav |
| SecondSixOfThree.wav |
| ThirdSixOfThree.wav |
| FirstSevenOfThree.wav |
| SecondSevenOfThree.wav |
| ThirdSevenOfThree.wav |
| FirstEightOfThree.wav |
| SecondEightOfThree.wav |
| ThirdEightOfThree.wav |
| FirstNineOfThree.wav |
| SecondNineOfThree.wav |
| ThirdNineOfThree.wav |
| FirstZeroOfThree.wav |
| SecondZeroOfThree.wav |
| ThirdZeroOfThree.wav |

Thus, by way of example, looking at the three-digit string 1, 1, 1, there will be a beginning 1, a middle 1, and an ending 1. When the three 1's are recorded, the natural inflection on the first 1 would be an upward inflection, the natural inflection on the middle 1 would be a flat inflection, and the natural inflection on the last 1 would be a falling inflection. Note then that when all ten digits have been recorded as triple digits (a string of 3), the individual number values therein can be interchanged because the string will be cut apart and stored so that there will be a beginning 1, a beginning 2, a beginning 3, etc., a middle 1, a middle 2, a middle 3, etc. and an end 1, an end 2, and an end 3, etc. This would also be true when the string length L=2, 4, or 5, or any desired length.

FIG. 3 shows one embodiment of process 30 for retrieving the proper spoken values when required. Process 301 identifies the needed string or strings of number values to a user. For example, the sequence 754 0631 consists of two strings with the first string having three positions and the second string having four positions. In the first string the value seven is in the first position, the value five in the second position, and the value four in the third position. In the second string the value zero is in the first position, the value six is in the second position, the value three is in the third position, and the value one is in the fourth position. In this example, the first string has a length L of three and the second string has a length L of four.

Once these values are recorded they can be reused, thereby limiting the amount of recordings that must be made to achieve a natural sound for number strings. This system avoids having the recorder record every possible combination in every one of the strings. To do so would require making thousands and thousands of recordings which is not feasible, mainly because it would take too long to record as well as using a larger amount of memory which is not always available, particularly in portable systems where the memory is limited. In addition to requiring a large memory it would take a long time to record all the possible combinations. After a while the spoken values would not sound consistent, and thus, when the number values are replayed they would not sound right to a recipient.

The reason why strings of two, three, four, and five are recorded separately is because there is a different inflection for each value for each such string length. A string of three flows differently than does a string of two, or a string of four, or a string of five. A string of six, seven, etc., is different still. While it is possible to record strings of two, strings of three, strings of four, strings of five, etc., up to strings of any number; it is not needed to go beyond a string of five because numbers are most often communicated in strings of two, three, four, or five. Phone numbers, zip codes, credit account numbers, social security numbers, all have a format that is broken into such strings. Even if a customer has a long account number it is almost always broken into a particular pattern, such as the first four (dash), the next five (dash), etc., thus, strings greater than five are almost never used. However, if desired, any string length could be used.

Process 302 determines how the string(s) are to be played. For example, in a personal social security number the system must play back a string of three, pause, a string of two, pause, a string of four. For a ten digit phone number (XXX YYY-ZZZZ), the system would require strings of three, three, and four.

Process 303 obtains from memory the numbers needed to play to the recipient. For example, assume an account number of 972-8816-54 is to be communicated. Table C shows the stored files that are to be retrieved. Note that the 9 from the first position of the first string is selected from the "three digit" recording as shown on line 01 of Table C. (First recorded and stored as shown in Table A3 and then broken apart and stored as shown in Table B, as discussed above.) The 7 from the second position of the first string is selected from the "three digit" recording as shown on line 02 of Table C, while the 2 from the third position of the first string is selected from the "three digit" recording as shown on line 03 of Table C.

A string of numbers having L=5 (for example, the string 62109), would use the number values 6, 2, 1, 0, and 9.

TABLE C

| Using Account Number Example (972-8316-54) | |
|---|---|
| FirstNineOfThree.wav | 9 |
| SecondSevenOfThree.wav | 7 |
| ThirdTwoOfThree.wav | 2 |
| Silence.wav | |
| FirstEightOfFour.wav | 8 |
| SecondThreeOfFour.wav | 3 |
| ThirdOneOfFour.wav | 1 |
| FourthSixOfFour.wav | 6 |
| Silence.wav | |
| FirstFiveOfTwo.wav | 5 |
| SecondFourOfTwo.wav | 4 |

Process 304 determines if the string is complete and process 303 reiterates until all values for the string are obtained. Process 305 determines if the sequence of strings is complete. If not, then the next sequence (in the example the four position sequence 8316) is retrieved from memory, followed by the next sequence, which is the two position sequence 54. When the values corresponding to all numbers for all strings are available, the values are assembled by process 305 as shown in Table C with pauses (or other sounds, such as dash, etc.) inserted as shown on lines 04 and 09 of Table C. Once assembled, the sequence of strings is played as shown by process 307.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of providing automated numeric voice inflections, said method comprising:

determining, by a processor, the values of each number to be communicated as a first string of numbers;

determining the length L of said first number string;

retrieving from a database a prerecording of the first value of said string, said first value having been prerecorded with an inflection that is a function of said first value being the first value of a string of numbers having length L;

retrieving from a database a prerecording of the second value of said string, said second value having been prerecorded with an inflection that is a function of said second value being the second value of a string of numbers having length L;

if L equals 2:

assembling said selected first and second prerecorded values; and communicating said first and second prerecorded values as retrieved;

if L equals 3:

retrieving from a database a prerecording of said third value of said string, said third value having been prerecorded with an inflection that is a function of said third value being the third number of a string of numbers having length L;

assembling said selected first, second, and third prerecorded values; and communicating said first, second, and third numbers as retrieved;

if L equals 4:

retrieving from a database a prerecording of said fourth value of said string, said fourth value having been prerecorded with an inflection that is a function of said fourth value being the fourth number of a string of numbers having length L;

assembling said retrieved first, second, and third prerecorded values; and communicating said first, second, third, and fourth prerecorded values as retrieved, wherein said inflections are without regard to the syntax of a sentence.

2. The method of claim 1 further comprising:

storing each possible value, from 0 though 9, in said database as a string of numbers having a length S, where S is any number between 1 and 4.

3. The method of claim 1 wherein said assembling is in ascending numeric order in accordance to the order said value was recorded in said string.

4. The method of claim 1 further comprising:

determining the values of each number to be communicated as a second string of numbers;

determining the length L of said second number string;

retrieving from a database the first value of said string, said first value having been prerecorded with an inflection that is a function of said first value being the first value of a string of numbers having length L;

retrieving from a database the second value of said string, said second value having been prerecorded with an inflection that is a function of said second value being the second value of a string of numbers having length L if L equals 2:

assembling said retrieved first and second values; and communicating said first and second values as retrieved;

if L equals 3:

retrieving from a database said third value of said string, said third value having been prerecorded with an inflection that is a function of said third value being the third value of a string of numbers having length L;

assembling said retrieved first, second and third values; and communicating said first, second and third values as retrieved;

if L equals 4:

retrieving from a database said fourth value of said string, said fourth value having been prerecorded with an inflection that is a function of said fourth value being the fourth value of a string of numbers having length L;

assembling said retrieved first, second and third values; and communicating said first, second, third and fourth values as retrieved.

5. A method for providing intonation in a string of spoken numbers, said method comprising:

for a length L of a desired number string, selecting a particular ordinate position N of said string and determining its value V;

retrieving, by a processor, from storage the prerecorded sound of value V, said sound of V having been prerecorded with an intonation that is a function of value being in the Nth position of a string of numbers having length L, wherein said intonation is without regard to the syntax of a sentence;

repeating said selecting and retrieving until all positions of said string have been retrieved;

assembling said retrieved prerecorded sounds in ascending string position;

assembling all retrieved prerecorded sounds for all strings;

inserting proper verbal separators between each said string; and communicating said prerecorded sounds to a listener, said communicating including communicating said assembled verbal separators.

6. The method of claim 5 further comprising:

communicating said assembled sounds to a listener.

7. The method of claim 5 further comprising:

for each additional number string repeating said selecting, retrieving, and repeating until prerecorded values for all strings have been retrieved.

8. A system for interacting with a user, said system comprising:

an interactive voice device;

a database having stored therein recorded sounds of number values, each said recorded sound value being part of a string of values having length L and each said value being recorded for each position in each said string, with an inflection that is a function of each said position in each said string, wherein said inflections are without regard to the syntax of a sentence;

a processor for retrieving from said database individual ones of said recorded sound values so as to assemble said retrieved sound values into a string of sound values for communication to said user; assembling all retrieved recorded sounds for all strings; inserting proper verbal separators between each said string; and communicating said recorded sounds to a listener, said communicating including communicating said assembled verbal separators.

9. The system of claim 8 wherein said processor is further operable for retrieving from said database individual ones of said recorded sound values for additional strings of sound values so as to assemble all of said retrieved sound values into said strings of sound values for communication of said sound values to said user as a plurality of stings of sound values.

10. The system of claim 8 wherein said database is located at a user location remote from said interactive voice device.

11. The system of claim 10 wherein said remote device is a mobile device.

12. The system of claim 11 wherein said mobile device is a cell phone.

13. A method for providing intonation in a string of prerecorded spoken numbers, said method comprising:

recording, by a processor, the sound of each number from 0 through 9 in a plurality of number strings each string having a different length such that the sound of each number is recorded for each position of said string as a function of each said position in each said string, wherein said intonation is without regard to the syntax of a sentence;

storing said recording for retrieving at a later time in order to provide audible reproduction of the values of number strings, wherein the values of the numbers in said number string being selected at the time of said audible reproduction;

assembling all retrieved prerecorded sounds for all strings;

inserting proper verbal separators between each said string; and communicating said prerecorded sounds to a listener, said communicating including communicating said assembled verbal separators.

14. The method of claim 13 wherein said storing comprises:

separating each said recorded number sound into individual numbers; and storing each said individual number from each string in association with the other numbers of said string.

15. The method of claim 14 wherein said storing is in conjunction with a communication system.

16. The method of claim 14 wherein said storing is in conjunction with a mobile device.

17. The method of claim 16 wherein said audible reproduction originates from said mobile device.

18. A device for verbally communicating numbers that have been prerecorded, said device comprising:

a memory;

data stored in said memory, said data comprising the recorded sound of each number from 0 through 9 in a plurality of number strings, each number string having a different length such that the sound of each number from 0 through 9 is recorded with an intonation for each position in each string as a function of each said position, and wherein each said recorded number sound is separated into individual numbers; and said intonation is without regard to the syntax of a sentence;

a processor for retrieving from said memory at least one string of numbers in order to provide audible reproduction of the values of said at least one number string, wherein the values of the numbers in said number string are selected at the time of said audible reproduction, and wherein the intonation of each said reproduced number value bears the natural intonation for both said string length and the positional location within said string of said number; assembling all retrieved prerecorded sounds for all strings; inserting proper verbal separators between each said string; and communicating said prerecorded sounds to a listener, said communicating including communicating said assembled verbal separators.

19. The device of claim 18 designed for use remote from a central communication system.

20. A system for providing automated numeric voice response, said system comprising:

means for determining the length L of each number string desired to be provided;

means for retrieving from a database a prerecording of a first value of a first said string, said first value having been prerecorded with an inflection that is a function of said first value being the first value of a string of numbers having length L of said first string;

means for retrieving from said database a prerecording of a second value of said first string, said second value having been prerecorded with an inflection that is a function of said second value being the second value of a string of numbers having length L of said first string;

if length L of said first string equals 2; said system further comprising:

means for assembling said selected first and second prerecorded values; and means for communicating said first and second prerecorded values as retrieved;

if length L of said first string equals 3; said system further comprising:

means for retrieving from said database a prerecording of a third value of said first string, said third value having been prerecorded with an inflection that is a function of said third value being the third number of a string of numbers having length L of said first string;

means for assembling said selected first, second, and third prerecorded values; and means for communicating said first, second, and third numbers as retrieved;

if length L of said first string equals 4; said system further comprising:

means for retrieving from said database a prerecording of said fourth value of said first string, said fourth value having been prerecorded with an inflection that is a function of said fourth value being the fourth number of a string of numbers having length L of said first string;

means for assembling said retrieved first, second, and third prerecorded values; and means for communicating said first, second, third, and fourth prerecorded values as retrieved, wherein said inflections are without regard to the syntax of a sentence.

21. The system of claim 20 further comprising:

means for storing each possible value, from 0 though 9, in said database as a string of numbers having a length S, where S is any number between 1 and 4.

22. The system of claim 20 wherein said assembling is in ascending numeric order in accordance with the order said value was recorded in said string.

23. The system of claim 20 further comprising:

for each additional number string N, said system comprises:

means for determining the length LN of said additional number string N;

means for retrieving from said database a first value of said Nth string, said first value having been prerecorded with an inflection that is a function of said first value being the first value of a string of numbers having length LN;

means for retrieving from said database a second value of said Nth string, said second value having been prerecorded with an inflection that is a function of said second value being the second value of a string of numbers having length LN;

if L equals 2; said system further comprising:

means for assembling said retrieved first and second values; and means for communicating said first and second values as retrieved;

if L equals 3; said system further comprising:

means for retrieving from a database a third number of said Nth string, said third value having been prerecorded with an inflection that is a function of said third value being the third value of a string of numbers having length LN;

means for assembling said retrieved first, second, and third values; and means for communicating said first, second, and third values as retrieved;

if L equals 4; said system further comprising:

means for retrieving from a database a fourth number of said Nth string, said fourth value having been prerecorded with an inflection that is a function of said fourth value being the fourth value of a string of numbers having length LN;

means for assembling said retrieved first, second and third values; and means for communicating said first, second, third and fourth values as retrieved.

24. A system for providing intonation in a string of spoken numbers, said system comprising:

for a length L of a desired number string, means for selecting a particular ordinate position N of said string and for determining its value V;

means for retrieving from storage the prerecorded sound of value V, said sound of V having been prerecorded with an intonation that is a function of value V being in the Nth position of a string of numbers having length L, wherein said intonation is without regard to the syntax of a sentence;

means for repeating said selecting and retrieving until all positions of said string have been retrieved; and means for assembling said retrieved prerecorded sounds in ascending string position.

25. The system of claim 24 further comprising:

means for communicating said assembled sounds to a listener.

26. The method of claim 24 further comprising:

means for assembling all retrieved prerecorded sounds for plurality of strings;

means for inserting proper verbal separators between each said string; and means for communicating said prerecorded sounds to a listener, said communicating including communicating said assembled verbal separators.

* * * * *

UNITED STATES PATENT AND TRADEMARK OFFICE

CERTIFICATE OF CORRECTION

PATENT NO. : 7,734,463 B1
APPLICATION NO. : 10/964046
DATED : June 8, 2010
INVENTOR(S) : Forrest McKay It is certified that error appears in the above-identified patent and that said Letters Patent is hereby corrected as shown below:

In the claims, an error exists in line 50 of column 8. Therefore, the following changes should be made:

> 9. The system of claim 8 wherein said processor is further operable for retrieving from said database individual ones of said recorded sound values for additional strings of sound values so as to assemble all of said retrieved sound values into said strings of sound values for communication of said sound values to said user as a plurality of strings ~~stings~~ of sound values.

Signed and Sealed this

Tenth Day of August, 2010

David J. Kappos

David J. Kappos
*Director of the United States Patent and Trademark Office*